US007640776B2

(12) United States Patent
Sälinger

(10) Patent No.: US 7,640,776 B2
(45) Date of Patent: Jan. 5, 2010

(54) EXPANDED METAL MACHINE

(75) Inventor: Johannes Sälinger, Wunstorf (DE)

(73) Assignee: Sorst Streckmetall GmbH, Hannover (DE)

( * ) Notice: Subject to any disclaimer, the term of this patent is extended or adjusted under 35 U.S.C. 154(b) by 0 days.

(21) Appl. No.: 11/826,509

(22) Filed: Jul. 16, 2007

(65) Prior Publication Data

US 2008/0016931 A1 Jan. 24, 2008

Related U.S. Application Data

(63) Continuation of application No. PCT/DE2006/000077, filed on Jan. 13, 2006.

(30) Foreign Application Priority Data

Jan. 15, 2005 (DE) ..... 10 2005 002 017

(51) Int. Cl.
*B21D 13/02* (2006.01)

(52) U.S. Cl. ..... 72/385; 72/414; 72/482.4

(58) Field of Classification Search ..... 72/307, 72/379.6, 385, 414, 482.3, 482.4, 482.5, 72/332, 374, 375, 380, 381, 412
See application file for complete search history.

(56) References Cited

U.S. PATENT DOCUMENTS 3,218,689 A 11/1965 Mumma
3,308,597 A 3/1967 Simonton
3,677,055 A 7/1972 Longhi
3,987,521 A 10/1976 Parkinson et al.
4,008,591 A * 2/1977 Vos et al. ..... 72/38
4,250,728 A * 2/1981 King ..... 72/177
4,450,706 A * 5/1984 Engelmohr ..... 72/385
4,502,315 A 3/1985 Dubrovsky et al.
4,989,440 A * 2/1991 Sjogren ..... 72/385
6,018,979 A * 2/2000 Davis ..... 72/482.4

(Continued)

FOREIGN PATENT DOCUMENTS

DE 34 25 193 A1 1/1985

(Continued)

OTHER PUBLICATIONS

International Search Report dated Jan. 17, 2006 in PCT/DE2005/001565, filed Sep. 7, 2005 (3 pages).

*Primary Examiner*—Edward Tolan
(74) *Attorney, Agent, or Firm*—Shlesinger, Arkwright & Garvey LLP

(57) ABSTRACT

Expanded metal machine includes a fixed blade, a displaceable blade, displaceable in a vertical and a transverse direction and which has a cutting edge with cutting projections interspaced in the transverse direction. Conveying device for conveying a flat material in a direction of conveyance between the blades. Ram for effecting a periodic vertical movement of displaceable blade, and a transverse displacing device for effecting a transverse displacement of displaceable blade that is synchronized with reciprocating motion. To enable a precise fine adjustment of the cutting gap, fixed blade is held in a fixed one-piece or multiple piece blade holding fixture vertically adjustable by a depth of cut adjusting device for adjusting a vertical depth of cut between the blades. Depth of cut adjusting device has at least two oppositely tapering wedges, displaceable in a coupled manner and having parallel sloped surfaces held in blade holding fixture in a sliding manner.

10 Claims, 4 Drawing Sheets

U.S. PATENT DOCUMENTS

| | | | | |
|---|---|---|---|---|
| 6,145,363 | A | 11/2000 | Farina et al. | |
| 6,192,731 | B1 * | 2/2001 | Toivanen | 72/307 |
| 6,834,525 | B2 * | 12/2004 | Leon et al. | 72/385 |
| 7,415,860 | B2 * | 8/2008 | Yamauchi | 72/385 |
| 2003/0187539 | A1 | 10/2003 | Smith | |

FOREIGN PATENT DOCUMENTS

| | | | |
|---|---|---|---|
| DE | 197 28 913 | C1 | 11/1997 |

* cited by examiner

EXPANDED METAL MACHINE

CROSS-REFERENCE TO RELATED APPLICATIONS

This application is a continuation of application No. PCT/DE2006/000077, filed Jan. 13, 2006, which claims the priority of German application No. 10 2005 002 017.8, filed Jan. 15, 2005, and each of which is incorporated herein by reference.

FIELD OF THE INVENTION

The invention relates to an expanded metal machine.

BACKGROUND OF THE INVENTION

Expanded metals are materials with orifices in the surface, which are produced by offset cuts without loss of material, while performing an expanding deformation at the same time, using flat materials, particularly metal sheets or metal strips.

In this process (with vertical orientation of the machine), the following steps are performed in consecutive cycles: the flat starting material is guided between blades, the starting material is cut by the moving blade while undergoing an expanding deformation, the blade is retracted vertically and then displaced laterally by half a mesh length, the blade is again displaced vertically for cutting into the starting material, thus creating the first meshes, and subsequently the blade is again vertically retracted and displaced laterally in the starting position, whereupon the starting material can again be fed. Thereafter, the expanded metal can be further processed, such as flat-rolled.

The expanded metals produced in this way are generally made of a high number of meshes in the longitudinal and transverse directions. During production, an even vertical cutting depth or immersion depth between the two blades is required since even minor deviations in the lateral direction, which is to say minor expansion differences of the meshes produced in one reciprocating movement, can form distortions in the finished mesh pattern, which are immediately apparent to the observer due to the regularity of the pattern, particularly in the case of larger widths and lengths. This may result in considerable visual impairment of the otherwise very aesthetic expanded metal. In the case of longer expanded metals, these distortions occurring in the longitudinal direction can add up and result in larger warping.

So as to correct and/or adjust the height positions of blades received in blade holding fixtures, at times a rough setting is performed in that cigarette paper or the like is placed between the blade and blade holding fixture. Such settings, however, are imprecise and only allow rough adjustments within discrete values.

U.S. Pat. No. 3,308,597 describes an expanded metal machine having a fixed blade, a displaceable blade, and the displaceable blade being vertically and transversely displaceable with a reciprocating motion in a vertical and a transverse direction, respectively. In that invention, cutting projections are formed both on the upper blade and on the lower blade, the projections engaging each other such that the flat material is received between the cutting projections disposed offset from one another during the cutting movement. Both the upper and the lower blades are displaced periodically in the lateral direction.

DE 197 28 913 C1 discloses an expanded metal machine, wherein for setting the cutting stroke and hence the mesh size of the expanded metal or mesh pattern to be produced a maximum cutting stroke can be reduced by means of adjusting wedges controlled by step motors. The maximum cutting stroke here is defined by eccentric disks provided on upper blade carriers or an upper blade holding fixture, the disks being driven by a shaft and pressing the upper blade carrier downward by means of the adjusting wedges.

OBJECTS AND SUMMARY OF THE INVENTION

It is therefore the object of the invention to create an expanded metal machine, which enables precise fine adjustment of the cutting depth.

This object is achieved with an expanded metal machine which includes a fixed blade, a displaceable blade, displaceable in a vertical and a transverse direction and which has a cutting edge with cutting projections interspaced in the transverse direction. A conveying device is provided for conveying a flat material in a direction of conveyance between the blades. There is a ram for effecting a periodic vertical movement of displaceable blade, and a transverse displacing device for effecting a transverse displacement of displaceable blade that is synchronized with reciprocating motion. To enable a precise fine adjustment of the cutting gap, fixed blade is held in a fixed one-piece or multiple piece blade holding fixture vertically adjustable by a depth of cut adjusting device for adjusting a vertical depth of cut between the blades. Depth of cut adjusting device has at least two oppositely tapering wedges, displaceable in a coupled manner and having parallel sloped surfaces held in blade holding fixture in a sliding manner.

This and other objects are achieved by the further preferred further embodiments as set forth below.

According to the invention, thus a wedge adjusting device is provided for the smooth or fixed blade. Advantageously, a plurality of gap adjusting devices are provided next to one another in the lateral or transverse direction, thus allowing fine correction of the course of the gap in the transverse direction. As a result of the wedge adjusting devices, continuous and precise adjustment becomes possible, wherein the wedges are advantageously received without clearance and, depending on the displacement in opposite directions, also enable opposite adjustments of the cutting gap.

According to a preferred embodiment, the wedge adjusting device has two oppositely tapering wedges, which are coupled to each other and have parallel sloped or inclined surfaces. In this way, effective adjustment in the vertical direction up and down becomes possible without clearance. The two wedges in turn can be displaced by a further wedge adjusting device with two coupled wedges, thus enabling a very high reduction ratio. The two further wedges can be displaced particularly in the vertical direction by a vertical wedge holding fixture, which—just like the fixed blade holding fixture—is received in a housing holding fixture in a vertically displaceable manner.

The displacement can be performed without interruption of the manufacturing process and can also be automated through NC drives.

The invention will be explained hereinafter with reference to the attached figures of one embodiment, wherein:

DETAILED DESCRIPTION OF THE INVENTION

Figure 1:
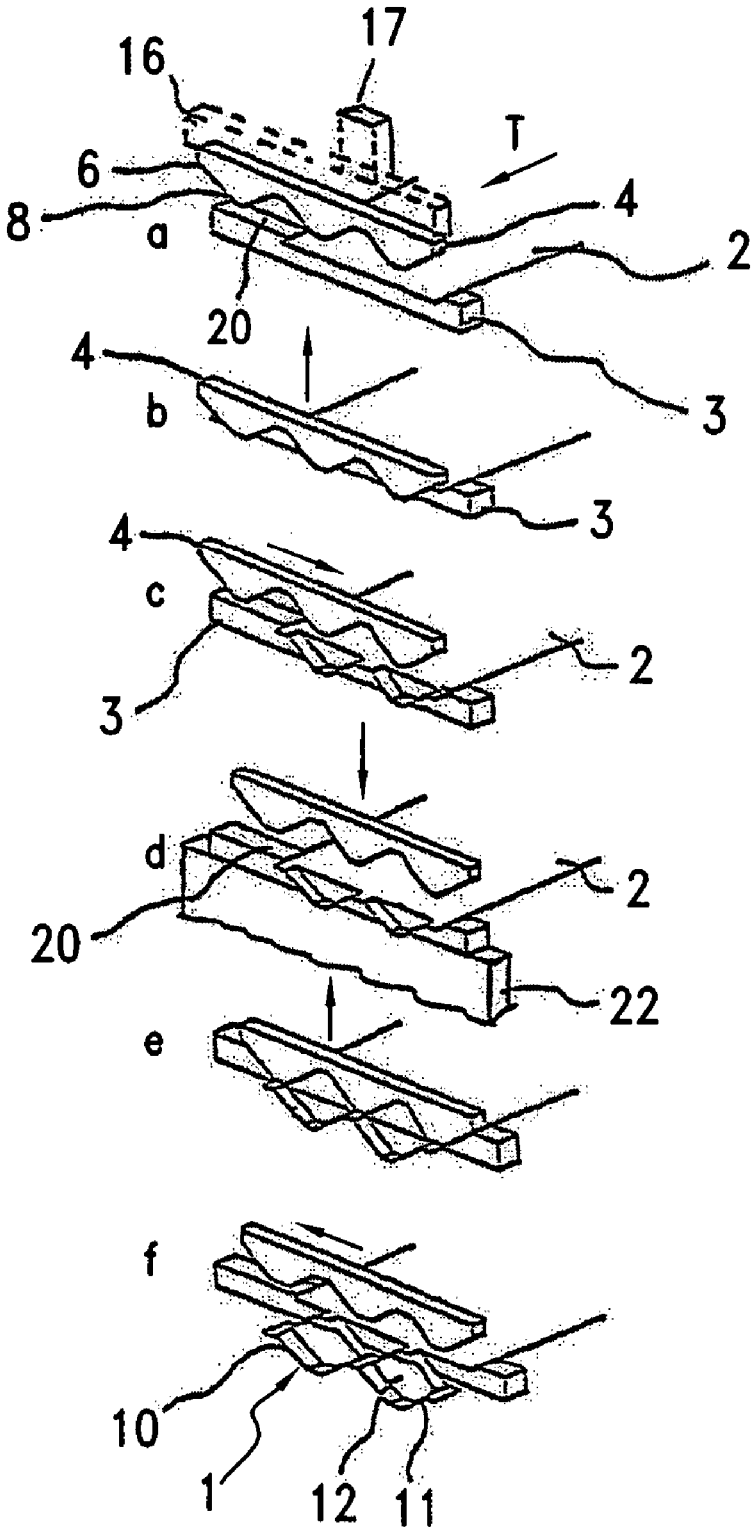
FIGS. 1*a-f* show the cutting process for producing an expanded metal.

So as to produce an expanded metal 1, a flat, metal starting material, such as a steel strip 2 from a coil, is processed by offset cuts without loss of material, while undergoing an expanding deformation at the same time. The metal strip 2 is guided between a lower blade 3 and an upper blade 4. In the embodiment shown according to FIGS. 1*a* to *f*, the upper blade 4 is displaced and the lower blade 3 is held rigidly. In principle, the reverse kinematic configuration is also possible advantageously according to the invention. The displaced blade 4 has a serrated cutting edge 6 with a plurality of cutting projections 8 in the transverse direction, the projections preferably being evenly spaced. The fixed lower blade 3 has an even configuration. So as to produce the expanded metal 1, according to FIG. 1*a* first the metal strip 2 is guided in the direction of conveyance T between the blades 3, 4 and thereafter the upper blade 4 is moved downward, so that according to FIG. 1*b* it cuts into the metal strip 2 with the cutting projections 8 and expands regions of the metal strip 2 that protrude downward beyond the lower blade 3 in the downward direction. According to FIG. 1*b*, the upper blade 6 is then displaced upward and thereafter, according to FIG. 1*c*, laterally by half a mesh width. According to FIG. 1*d*, the upper blade 4 is then guided downward and again cuts into the metal strip 2 in positions offset by half a mesh in relation to the first cuts, expanding the developing cross-members 10 of the expanded metal 1 in the downward direction, so that rhombic meshes 11 are formed with the orifices 12 surrounded by the cross-members 10. Thereafter, according to FIG. 1*e*, the upper blade 4 is displaced again upward and then, according to FIG. 1*f*, in the lateral direction back into the starting position according to FIG. 1*a*.

As shown in FIG. 1, the direction of conveyance T of the conveying device conveying a flat material is transverse relative to the vertical direction of the displaceable blade and is likewise transverse relative to the lateral direction of the displaceable blade.

Figure 2:
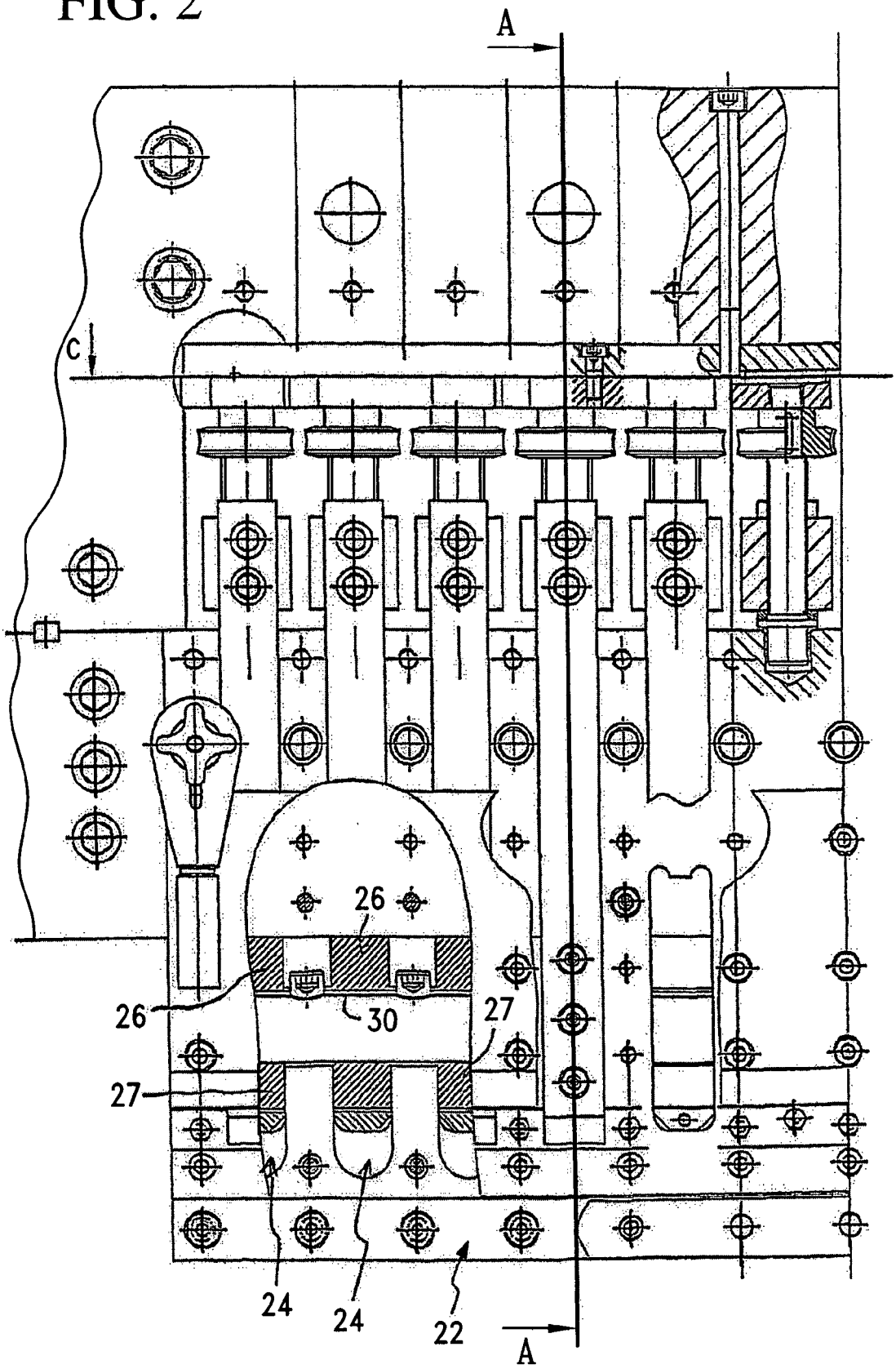
FIG. 2 is a front view of the blade holding fixture with the cutting depth adjusting device.

According to the invention, the vertical cutting depth 20 is adjusted on the fixed blade, which according to the embodiment shown in FIG. 1 can be the lower blade, according to the invention, however, advantageously can also be the upper blade. FIG. 2 shows a front view of the fixed blade holding fixture 22. In the lateral direction and next to one another, a plurality of individual blades or advantageously a continuous fixed blade (not shown here) are disposed on the fixed blade holding fixture 22.

The blade holding fixture 22 is displaced in the vertical direction to adjust the cutting depth 20 by means of a plurality of laterally adjacently disposed immersion or cutting depth adjusting devices 24. The cutting depth adjusting device 24 has two oppositely tapering wedges 26, 27, which are slidably mounted in sliding elements 30 of the blade holding fixture 22. The wedges 26 and 27 each have a horizontal surface 26*a* or 27*b* and a sloped surface 26*b* or 27*a*, wherein the sloped surfaces 26*b*, 27*a* extend parallel to one another and receive a center region 22*a* of the blade holding fixture between them, the region accordingly having upper and lower sloped surfaces with sliding elements 30. The wedges 26, 27 here are received between the sliding elements 30 of the blade holding fixture 22 without clearance.

Figure 3:
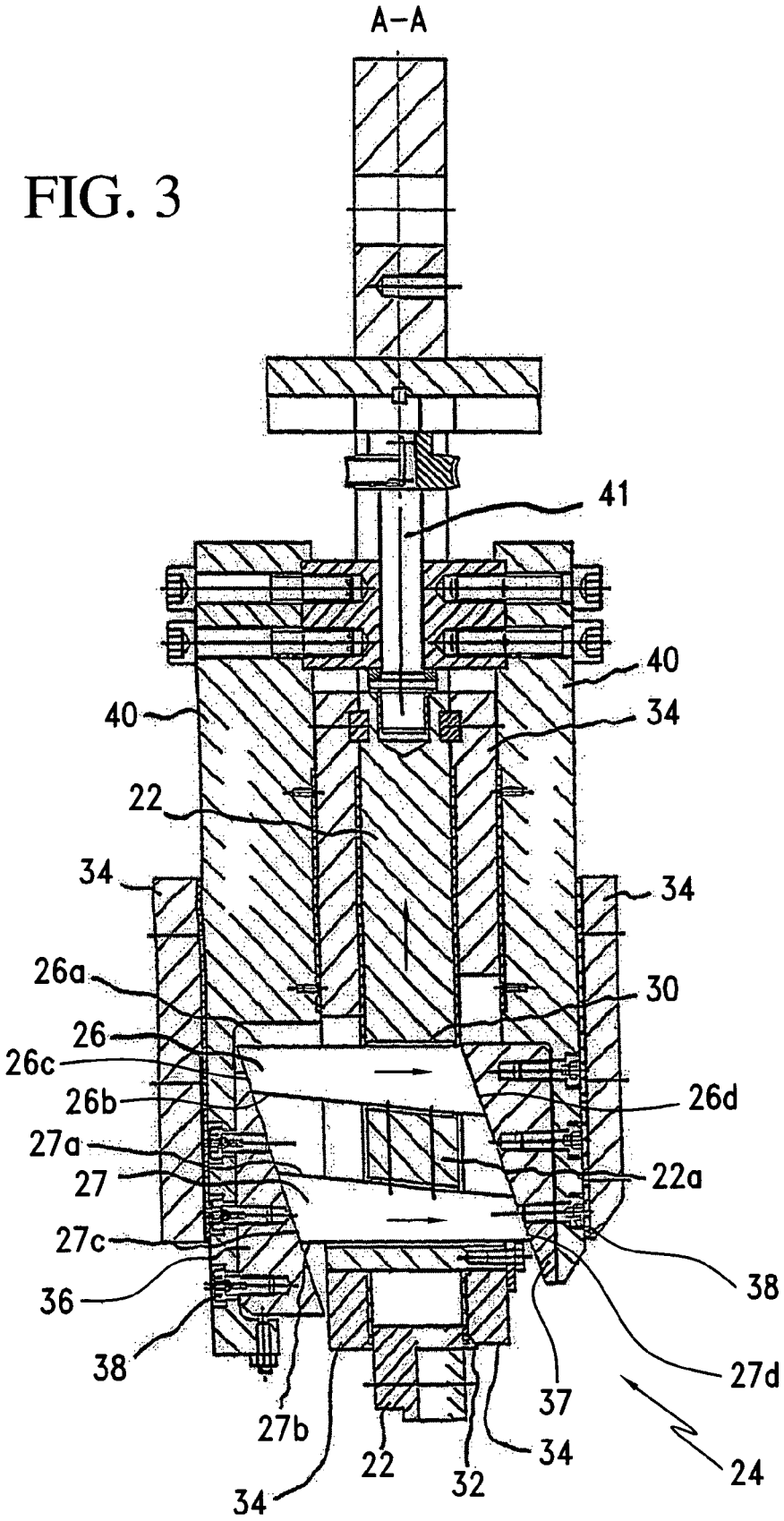
FIG. 3 shows the vertical section A-A according to FIG. 2.
Figure 4:
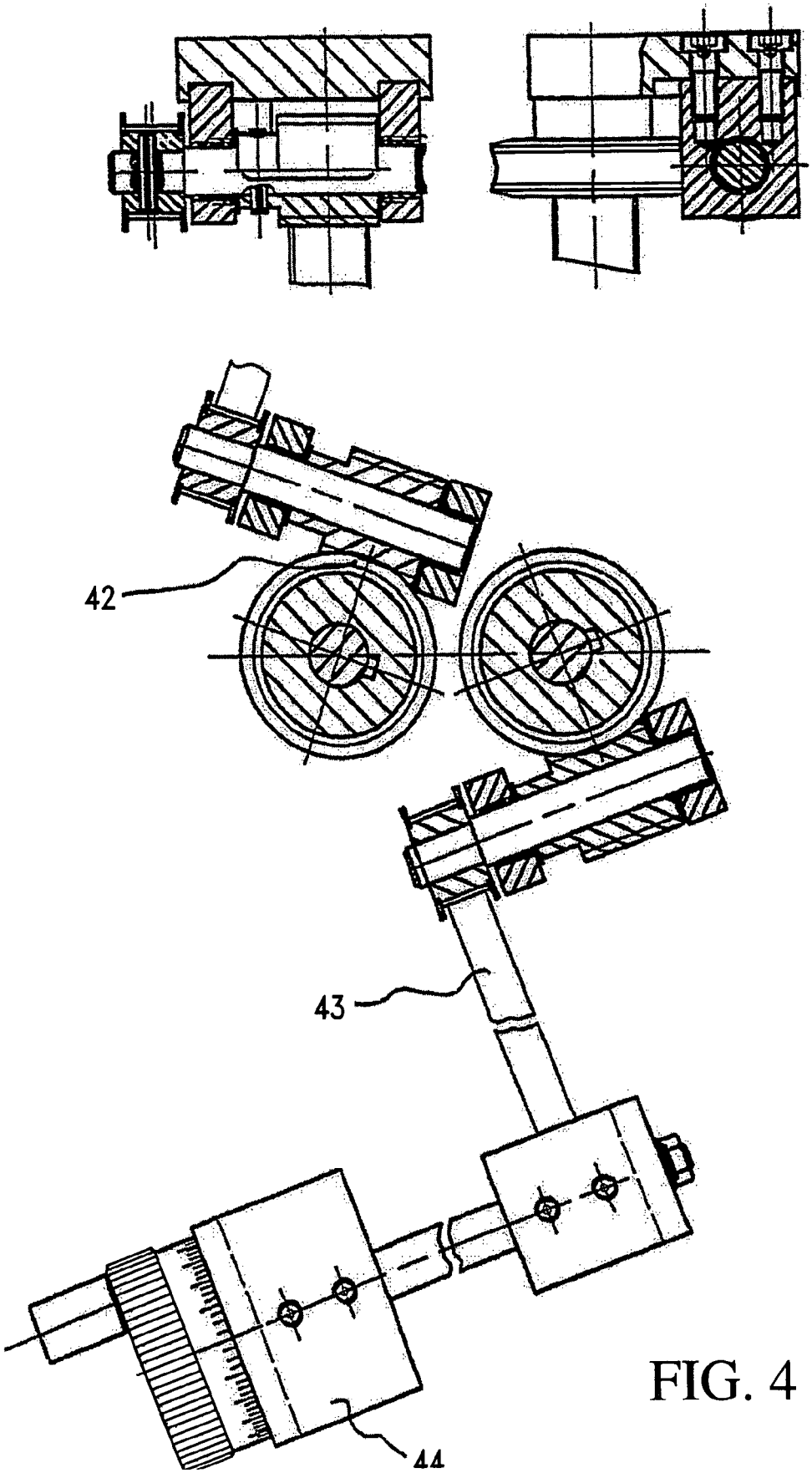
FIG. 4 shows the adjusting mechanism of the cutting depth adjusting device according to FIG. 2.

In the case of a coupled longitudinal adjustment of the wedges 26, 27 according to FIG. 3 to the right, the blade holding fixture 22 is adjusted vertically upward in accordance with a reduction ratio determined by the gradient of the surfaces 26*b*, 27*a*, such as 1:10. Accordingly, the blade holding fixture 22 is displaced downward with a longitudinal displacement of the wedges 26, 27 to the left at the same reduction ratio. The blade holding fixture 22 is slidably mounted in a housing holding fixture 34, for example by means of vertical sliding elements 32.

The displacement of the wedges 26, 27 is advantageously likewise performed by wedges. For this purpose, two in the vertical direction oppositely tapering wedges 36, 37 are fastened to a vertical wedge holding fixture 40 by means of screws or bolts 38, the wedge holding fixture being slidably received in the housing holding fixture 34. The wedges 36, 37 with the sloped surfaces thereof rest against correspondingly sloped faces 26*c*, 26*d* of the wedge 26 and corresponding sloped faces 27*c*, 27*d* of the wedge 27. During a vertical upward displacement of the vertical wedge holding fixture 40 by means of the wedges 36, 37 in the upward direction, thus the wedges 26, 27 are displaced in the longitudinal direction according to FIG. 3 to the right; depending on the gradient of the sloped faces 26*c, d* and 27*c, d* in turn a corresponding reduction ratio is obtained. In the illustrated embodiment, a displacement range of 30 mm of the wedge holding fixture 40 may result in a displacement range of 10 mm of the wedges 26, 27 and accordingly a displacement range of 1 mm of the blade holding fixture 22, which is to say an overall reduction ratio of 1:30. The wedge holding fixture 40 in turn can experience further reduction, for example by a threaded drive 41 and a worm drive 42. The displacement can then be performed via a belt drive 43 and a hand wheel 44, which can advantageously also be replaced with an NC drive. The displacement can be performed without interrupting the machine operation (expanded metal production). According to the—partially cut—front view of FIG. 2, fine adjustment of the vertical cutting depth 20 in the lateral direction can be performed via a plurality of gap adjusting devices 24, which each comprise a pair of horizontal wedges 26, 27, a pair of vertical wedges 36, 37 and threaded and worm drives 41 and 42 that displace these wedges, the drives being used for the fine adjustment via the hand wheel 44.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. An expanded metal machine, comprising:

a) a fixed blade;

b) a displaceable blade, the displaceable blade being vertically and transversely displaceable with a reciprocating motion in a vertical and a transverse direction, respectively;

c) a cutting edge provided on the displaceable blade, the cutting edge having cutting projections interspaced in the transverse direction;

d) a conveying device for conveying a flat material in a direction of conveyance between the fixed blade and the displaceable blade, the direction of conveyance being transverse relative to the vertical direction of the displaceable blade and the direction of conveyance being transverse relative to the lateral direction of the displaceable blade;

e) a ram for effecting a periodic vertical movement of the displaceable blade in the vertical direction;

f) a transverse displacing device configured for effecting a transverse displacement of the displaceable blade in the transverse direction, the transverse direction being different from the direction of conveyance, and the transverse displacing device being synchronized with the reciprocating motion of the displaceable blade;

g) the fixed blade being received in a vertically adjustable fixed blade holding fixture, which is vertically adjustable for adjustment of a vertical immersion or cutting depth between the fixed blade and the displaceable blade by a cutting depth adjusting device having at least two wedges; and h) the cutting depth adjusting device being a gap adjusting device, and the at least two wedges including two oppositely tapering wedges displaceable in a coupled manner and have parallel sloped surfaces and that are slidably received in the blade holdinq fixture.

2. The expanded metal machine according to claim 1, wherein:

a) the sloped surfaces of the two wedges face each other, and between them a center region of the fixed blade holding fixture is disposed that includes parallel surfaces configured for receiving the sloped surfaces.

3. The expanded metal machine according to claim 1, wherein:

a) the two wedges are received in the fixed blade holding fixture without clearance.

4. An expanded metal machine according to claim 1, wherein:

a) the two wedges are displaceable by two further wedges, which are coupled to each other and rest against the sloped faces of the two wedges, and which displace them in a coupled manner.

5. The expanded metal machine according to claim 4, wherein:

a) the two further wedges are vertically displaceable and are fastened in a vertical wedge holding fixture.

6. The expanded metal machine according to claim 5, wherein:

a) the fixed blade holding fixture and the vertical wedge holding fixture are received in a vertically sliding manner in a fixed housing holding fixture.

7. An expanded metal machine according to claim 5, wherein:

a) the vertical wedge holding fixture for the two further wedges is vertically displaceable by threaded and worm drives.

8. An expanded metal machine according to claim 3, wherein:

a) the cutting depth adjusting device includes a plurality of cutting depth adjusting devices adjacent to one another in the transverse direction, and the vertical cutting gap is adjustable along the transverse direction thereof by the plurality of cutting depth adjusting devices.

9. An expanded metal machine according to claim 2, wherein:

a) the cutting depth adjusting device includes a plurality of cutting depth adjusting devices adjacent to one another in the transverse direction, and the vertical cutting gap is adjustable along the transverse direction thereof by the plurality of cutting depth adjusting devices.

10. An expanded metal machine according to claim 1, wherein:

a) the cutting depth adjusting device includes a plurality of cutting depth adjusting devices adjacent to one another in the transverse direction, and the vertical cutting gap is adjustable along the transverse direction thereof by the plurality of cutting depth adjusting devices.

* * * * *